US009966736B2

(12) United States Patent
Matsushita et al.

(10) Patent No.: US 9,966,736 B2
(45) Date of Patent: May 8, 2018

(54) SPARK PLUG

(71) Applicant: NGK SPARK PLUG CO., LTD., Nagoya-shi, Aichi (JP)

(72) Inventors: Daisuke Matsushita, Nagoya (JP); Masahiro Inoue, Gifu (JP)

(73) Assignee: NGK SPARK PLUG CO., LTD., Nagoya-shi (JP)

( * ) Notice: Subject to any disclaimer, the term of this patent is extended or adjusted under 35 U.S.C. 154(b) by 0 days. days.

(21) Appl. No.: 15/481,569

(22) Filed: Apr. 7, 2017

(65) Prior Publication Data

US 2017/0294763 A1 Oct. 12, 2017

(30) Foreign Application Priority Data

Apr. 11, 2016 (JP) ..... 2016-078910

(51) Int. Cl.
*H01T 13/39* (2006.01)
*H01T 13/08* (2006.01)
*H01T 13/32* (2006.01)

(52) U.S. Cl.
CPC ..... *H01T 13/39* (2013.01); *H01T 13/08* (2013.01); *H01T 13/32* (2013.01)

(58) Field of Classification Search
None
See application file for complete search history.

(56) References Cited

U.S. PATENT DOCUMENTS

| | | | | |
|---|---|---|---|---|
| 8,922,104 | B1 * | 12/2014 | Inoue | H01T 13/20 313/141 |
| 9,172,215 | B2 * | 10/2015 | Sakakura | H01T 13/32 |
| 9,742,158 | B2 * | 8/2017 | Suzuki | H01T 13/32 |
| 2005/0023949 | A1 | 2/2005 | Hori | |
| 2005/0077807 | A1 | 4/2005 | Suzuki et al. | 313/141 |
| 2007/0128964 | A1 | 6/2007 | Hori | |
| 2008/0029053 | A1 | 2/2008 | Suzuki et al. | 123/169 R |

(Continued)

FOREIGN PATENT DOCUMENTS

| | | | |
|---|---|---|---|
| JP | 200550732 A | 2/2005 | |
| JP | 2005-123182 A | 5/2005 | H01T 13/20 |
| JP | 2012-074271 A | 4/2012 | H01T 13/20 |

OTHER PUBLICATIONS

Extended European Search Report issued in corresponding European Patent Application No. 17165519.4, dated Aug. 30, 2017.

(Continued)

*Primary Examiner* — Ashok Patel
(74) *Attorney, Agent, or Firm* — Kusner & Jaffe

(57) ABSTRACT

A spark plug having a center electrode, a ground electrode, and a noble metal tip that is joined to a part of the ground electrode near one end of the ground electrode via a fused portion. The fused portion extends outward beyond an outer shape of the noble metal tip so that a part of the fused portion is present at each of positions that are located inward from and separated from both side edges of the ground electrode in a width direction of the ground electrode. The fused portion includes a fused protrusion that is located near at least one of two side edges of the noble metal tip in the width direction of the ground electrode and that protrudes in a direction away from the one end of the ground electrode.

3 Claims, 11 Drawing Sheets

(56) References Cited

U.S. PATENT DOCUMENTS

| | | | | |
|---|---|---|---|---|
| 2012/0176019 | A1* | 7/2012 | Suzuki | H01T 13/32 313/141 |
| 2013/0320835 | A1 | 12/2013 | Kowalski et al. | 313/141 |
| 2014/0042892 | A1 | 2/2014 | Kowalski et al. | 313/141 |
| 2014/0111078 | A1* | 4/2014 | Kowalski | H01T 13/39 313/141 |

OTHER PUBLICATIONS

Office Action issued in corresponding Japanese Patent Application No. 2016-078910 dated Mar. 6, 2018.

* cited by examiner

FIG. 12

| Δy (mm) | POSITION OF FUSED PROTRUSION: Lb + Δ (mm) (DISTANCE Δ FROM SIDE EDGE OF TIP: + OUTSIDE, − INSIDE) | | | | |
|---|---|---|---|---|---|
| | −0.4 | −0.2 | 0 | 0.2 | 0.4 |
| 0.20 | F | G | G | G | F |
| 0.15 | F | G | G | G | F |
| 0.10 | F | G | G | G | F |
| 0.05 | F | F | G | F | F |

TEST CONDITIONS
3000 THERMAL CYCLES
SHAPE OF FUSED PORTION: ONE PROTRUSION
SQUARE TIP (1.3 mm × 1.3 mm)

EVALUATION CRITERION (OXIDE SCALE DEVELOPMENT RATIO)
G: LESS THAN 50%
F: 50% OR GREATER

FIG. 13

| Δy (mm) | POSITION OF FUSED PROTRUSION: Lb + Δ (mm) (DISTANCE Δ FROM SIDE EDGE OF TIP: + OUTSIDE, − INSIDE) | | | | |
|---|---|---|---|---|---|
| | −0.4 | −0.2 | 0 | 0.2 | 0.4 |
| 0.20 | F | G | G | G | G |
| 0.15 | F | G | G | G | F |
| 0.10 | F | G | G | G | F |
| 0.05 | F | F | G | F | F |

TEST CONDITIONS
3000 THERMAL CYCLES
SHAPE OF FUSED PORTION: ONE PROTRUSION
CIRCULAR TIP (ϕ1.5 mm)

EVALUATION CRITERION (OXIDE SCALE DEVELOPMENT RATIO)
G: LESS THAN 50%
F: 50% OR GREATER

FIG. 14

| Δy (mm) | POSITION OF FUSED PROTRUSION: Lb + Δ (mm) | | |
|---|---|---|---|
| | −0.2 | 0 | 0.2 |
| 0.20 | F | G | F |
| 0.15 | F | G | F |
| 0.10 | F | F | F |

TEST CONDITIONS

5000 THERMAL CYCLES
SHAPE OF FUSED PORTION: ONE PROTRUSION
SQUARE TIP (1.3 mm × 1.3 mm)

EVALUATION CRITERION (OXIDE SCALE DEVELOPMENT RATIO)

G: LESS THAN 50%
F: 50% OR GREATER

FIG. 15

| Δy (mm) | POSITION OF FUSED PROTRUSION: Lb + Δ (mm) | | |
|---|---|---|---|
| | −0.2 | 0 | 0.2 |
| 0.20 | G | G | G |
| 0.15 | F | G | F |
| 0.10 | F | F | F |

TEST CONDITIONS

5000 THERMAL CYCLES
SHAPE OF FUSED PORTION: TWO PROTRUSIONS
SQUARE TIP (1.3 mm × 1.3 mm)

EVALUATION CRITERION (OXIDE SCALE DEVELOPMENT RATIO)

G: LESS THAN 50%
F: 50% OR GREATER

SPARK PLUG

RELATED APPLICATION

This application claims the benefit of Japanese Patent Application No. 2016-078910, filed Apr. 11, 2016, the entire contents of which are incorporated herein by reference.

FIELD OF THE INVENTION

The present invention relates to a spark plug.

BACKGROUND OF THE INVENTION

In general, spark plugs include a center electrode and a ground electrode in a front end portion thereof. To date, in order to address a need for improvement of ignitability and wear resistance of spark plugs, spark plugs having a noble metal tip that is joined to a part of the ground electrode near one end of the ground electrode have been used.

In general, the coefficient of thermal expansion differs between the noble metal tip and the ground electrode. Therefore, when the spark plug is subjected to thermal cycles during use, the noble metal tip may become separated from the ground electrode. For this reason, to date, various joining methods have been devised to prevent separation of the noble metal tip (see Japanese Unexamined Patent Application Publication No. 2005-123182 and Japanese Unexamined Patent Application Publication No. 2012-074271).

However, because spark plugs are more likely to be used under severer conditions in recent years, further improvement in the separation resistance of the noble metal tip is needed.

The present invention, which has been devised to solve the aforementioned problem.

SUMMARY OF THE INVENTION (1) According to a first aspect of the present invention, there is provided a spark plug that includes a center electrode; a ground electrode; and a noble metal tip that has a spark surface facing the center electrode with a spark gap therebetween and that is joined to a part of the ground electrode near one end of the ground electrode via a fused portion. In the spark plug, when the ground electrode, the noble metal tip, and the fused portion are projected in a direction perpendicular to the spark surface, the fused portion extends outward beyond an outer shape of the noble metal tip so that a part of the fused portion is present at each of positions that are located inward from both side edges of the ground electrode and separated from the side edges in a width direction of the ground electrode; and the fused portion includes a fused protrusion that is located near at least one of two side edges of the noble metal tip in the width direction of the ground electrode and that protrudes in a direction away from the one end. With the spark plug, due to the presence of the fused protrusion, it is possible to suppress formation of oxide scale near the boundary between the ground electrode and the noble metal tip, and therefore the separation resistance of the noble metal tip is improved.

(2) In accordance with a second aspect of the present invention, there is provided a spark plug as described above, wherein, when the ground electrode, the noble metal tip, and the fused portion are projected in the direction perpendicular to the spark surface, and when a maximum tip width of the noble metal tip in the width direction of the ground electrode is denoted by W, a straight line that passes through a center of the noble metal tip and that extends in a longitudinal direction perpendicular to the width direction is denoted by La, a contact line that is in contact with the one of the side edges of the noble metal tip and that extends in the longitudinal direction is denoted by Lb, a first position, which is a position on the fused portion that is within a distance of ±W/4 from the straight line La in the width direction and that is farthest from the one end of the ground electrode, is denoted by P1, a second position, which is a position on the fused protrusion that is within a distance of ±0.2 mm from the contact line Lb in the width direction and that is farthest from the one end of the ground electrode, is denoted by P2, and a length between the second position P2 and the first position P1 in the longitudinal direction is denoted by Δy, the length Δy may satisfy Δy≥0.1 mm. With this structure, the separation resistance of the noble metal tip is further improved.

(3) In accordance with a third aspect of the present invention, there is provided a spark plug as described above, wherein, when the ground electrode, the noble metal tip, and the fused portion are projected in the direction perpendicular to the spark surface, the fused protrusion may be present at each of positions near the two side edges of the noble metal tip in the width direction of the ground electrode. With this structure, due to the presence of two fused protrusions, the separation resistance of the noble metal tip is further improved.

The present invention can be realized in various ways. For example, the present invention can be realized as a method of manufacturing a spark plug, a method of manufacturing a ground electrode for a spark plug, and the like.

BRIEF DESCRIPTION OF THE DRAWINGS

FIG. 12 is a table showing the results of an experiment performed to examine the effect of a fused protrusion on development of oxide scale;

FIG. 13 is a table showing the results of an experiment performed to examine the effect of a fused protrusion on development of oxide scale;

FIG. 14 is a table showing the results of an experiment performed to examine the effect of a fused protrusion on development of oxide scale; and FIG. 15 is a table showing the results of an experiment performed to examine the effect of fused protrusions on development of oxide scale.

DETAILED DESCRIPTION OF THE PREFERRED EMBODIMENTS

Figure 1:
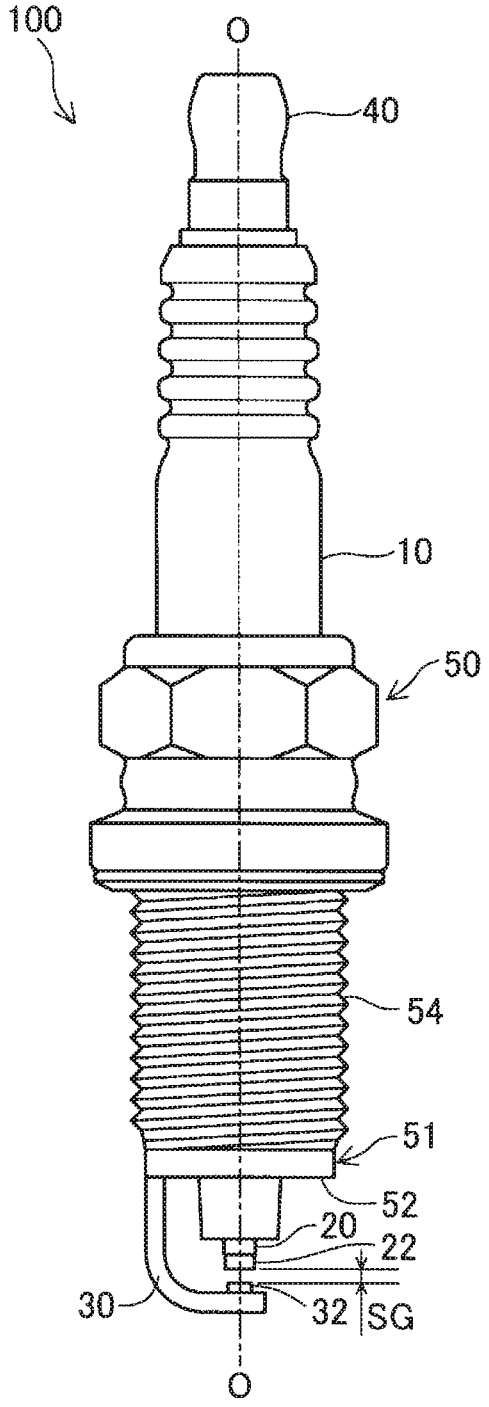
FIG. 1 is a side view of a spark plug according to an embodiment.

FIG. 1 is a side view of a spark plug 100 according to an embodiment of the present invention. In the following description, the lower side of FIG. 1, in which a spark gap SG is present, will be referred to as the "front side" of the spark plug 100, and the upper side of FIG. 1 will be referred to as the "rear side" of the spark plug 100. The spark plug 100 includes an insulator 10, a center electrode 20, a ground electrode 30, a terminal nut 40, and a metallic shell 50. The insulator 10 has an axial hole that extends along an axis O. The axis O will be also referred to as the "center axis." The center electrode 20, which is a rod-shaped electrode extending along the axis O, is inserted and held in the axial hole of the insulator 10. A rear end portion of the ground electrode 30 is fixed to a front end surface 52 of a front end portion 51 of the metallic shell 50. A front end portion of the ground electrode 30 faces the center electrode 20. The terminal nut 40, which is a terminal for receiving supply of electric power, is electrically connected to the center electrode 20. A noble metal tip 22 is welded to the front end of the center electrode 20. A noble metal tip 32 is welded to an inner surface of a part of the ground electrode 30 near one end of the ground electrode 30. A surface of the noble metal tip 32 of the ground electrode 30 functions as a spark surface of the ground electrode 30. The noble metal tips 22 and 32 are made of a noble metal, such as platinum (Pt) or iridium (Ir), or an alloy including a noble metal. The noble metal tip 22 of the center electrode 20 may be omitted. In FIG. 1, for convenience of drawing, the noble metal tips 22 and 32 are enlarged in scale. The spark gap SG is formed between the two tips 22 and 32. The metallic shell 50 is a tubular member that surrounds the insulator 10, and the insulator 10 is fixed to the inside of the metallic shell 50. A threaded portion 54 is formed on the outer periphery of the metallic shell 50. The threaded portion 54, on which a screw thread is formed, is screwed into a tapped hole in an engine head when attaching the spark plug 100 to the engine head. The front end portion 51 of the metallic shell 50, on which a screw thread is not formed, is located on the front side of the threaded portion 54.

Figure 2A:
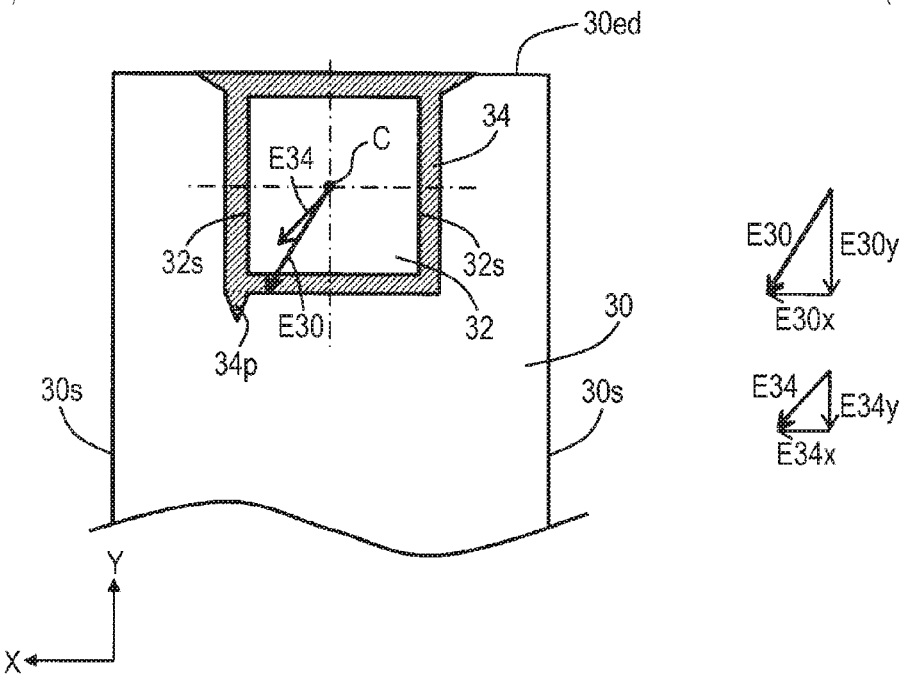
FIG. 2A is a plan view of a front end portion of a ground electrode according to the embodiment, which is projected in a direction perpendicular to a spark surface of a noble metal tip.

FIG. 2A is a plan view of the front end portion of the ground electrode 30 according to the embodiment, which is projected in a direction perpendicular to a surface (spark surface) of the noble metal tip 32. In FIG. 2A, the width direction X of the ground electrode 30 and the longitudinal direction Y of the ground electrode 30, which is perpendicular to the width direction X, are shown. The noble metal tip 32 is joined to a part of the ground electrode 30 near an end 30*ed* of the ground electrode 30 in the longitudinal direction via a fused portion 34. The fused portion 34 is formed, for example, when joining the noble metal tip 32 to the ground electrode 30 by laser welding. The fused portion 34 extends beyond the outer shape of the noble metal tip 32. The fused portion 34 extends over the entirety of the back surface of the noble metal tip 32. Preferably, the fused portion 34 extends to the end 30*ed* of the ground electrode 30 in the longitudinal direction Y. Body portions of the ground electrode 30 (which are not fused) are present on the left and right sides of the fused portion 34 in the width direction X. In other words, in the plan view, a part of the fused portion 34 is present at each of positions that are located inward from both side edges 30*s* of the ground electrode 30 in the width direction X of the ground electrode 30 and separated from both side edges 30*s*. The fused portion 34 includes a fused protrusion 34*p* that is located near one of side edges 32*s* of the noble metal tip 32 of the ground electrode 30 in the width direction X of the ground electrode 30 and that protrudes in a direction away from the end 30*ed* of the ground electrode 30 in the longitudinal direction Y. As described below, the fused protrusion 34*p* has an effect of suppressing formation of oxide scale near the boundary between the fused portion 34 and the ground electrode 30. In the following description, for the purpose of differentiation, a portion of the ground electrode 30 excluding the noble metal tip 32 and the fused portion 34 will be referred to as a "ground electrode body 30".

Figure 2B:
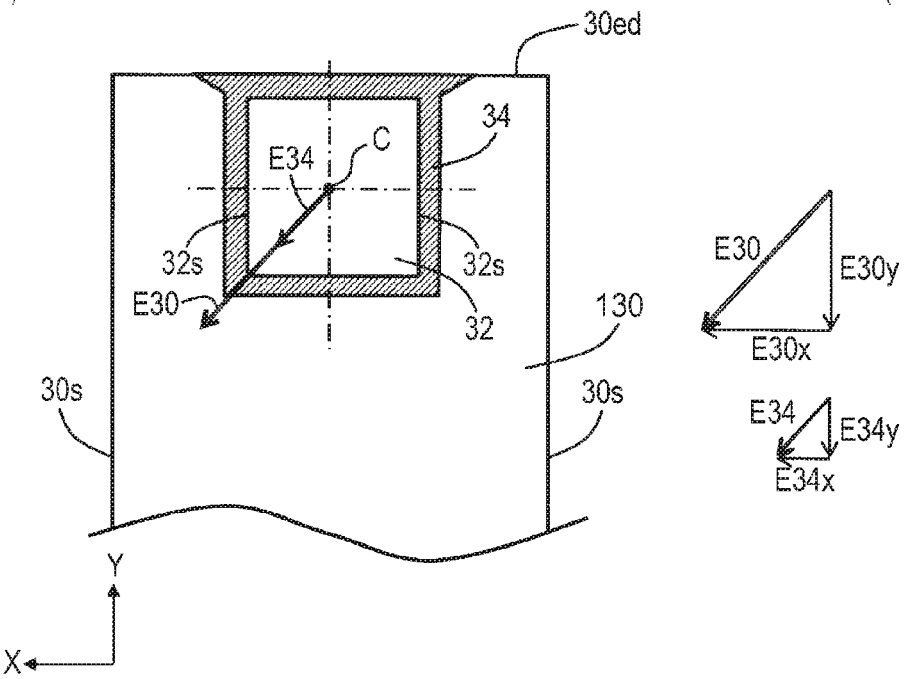
FIG. 2B (Prior Art)
FIG. 2B is a plan view of a front end portion of a ground electrode according to a comparative example, which is projected in a direction perpendicular to a spark surface of a noble metal tip.

FIG. 2B is a plan view of a ground electrode 130 according to a comparative example. Except that the fused portion 34 does not have the fused protrusion 34*p*, the comparative example is the same as the embodiment shown in FIG. 2A. Here, a thermal expansion vector E30, having an initial point at the center C of the fused portion 34 and representing the degree of thermal expansion of the ground electrode body 30, and a thermal expansion vector E34, having an initial point at the center C of the fused portion 34 and representing the degree of thermal expansion of the fused portion 34 are shown. On the right side of FIG. 2B, X-direction components E30*x* and E34*x* and Y-direction components E30*y* and E34*y* of the thermal expansion vectors E30 and E34 are also shown. In general, the magnitude of the thermal expansion vector E30 of the ground electrode body 30 is greater than that of the thermal expansion vector E34 of the fused portion 34. At a position far from the center C of the fused portion 34, the difference in the amount of thermal expansion between the fused portion 34 and the ground electrode body 30 is large. Therefore, when the temperature of the ground electrode body 30 becomes high, a large stress is generated at the interface between the fused portion 34 and the ground electrode body 30. When such a large stress is generated in high temperature, oxides (oxide scale) tend to be formed at the interface between the fused portion 34 and the ground electrode body 30 and the oxide scale tends to develop. The oxide scale causes the separation resistance of the noble metal tip 32 to decrease.

In contrast, in the embodiment illustrated in FIG. 2A, the fused protrusion 34*p* is formed near one of the side edges 32*s* of the noble metal tip 32. The fused protrusion 34*p* functions as an obstacle that makes it difficult for the ground electrode body 30 to thermally expand in the X direction. As a result, the X-direction component E30*x* of the thermal expansion vector E30 of the ground electrode body 30 is smaller than that of the comparative example shown in FIG. 2B. Moreover, the difference in the amount of thermal expansion between the fused portion 34 and the ground electrode body 30 (in particular, the difference between the X-direction components E30*x* and E34*x*) is smaller than that of the comparative example. Accordingly, in the embodiment, a stress generated at the interface between the fused portion 34 and the ground electrode body 30 is smaller than that of the comparative example, and therefore formation of oxide scale is suppressed. As a result, the separation resistance of the noble metal tip 32 is improved.

Figure 3:
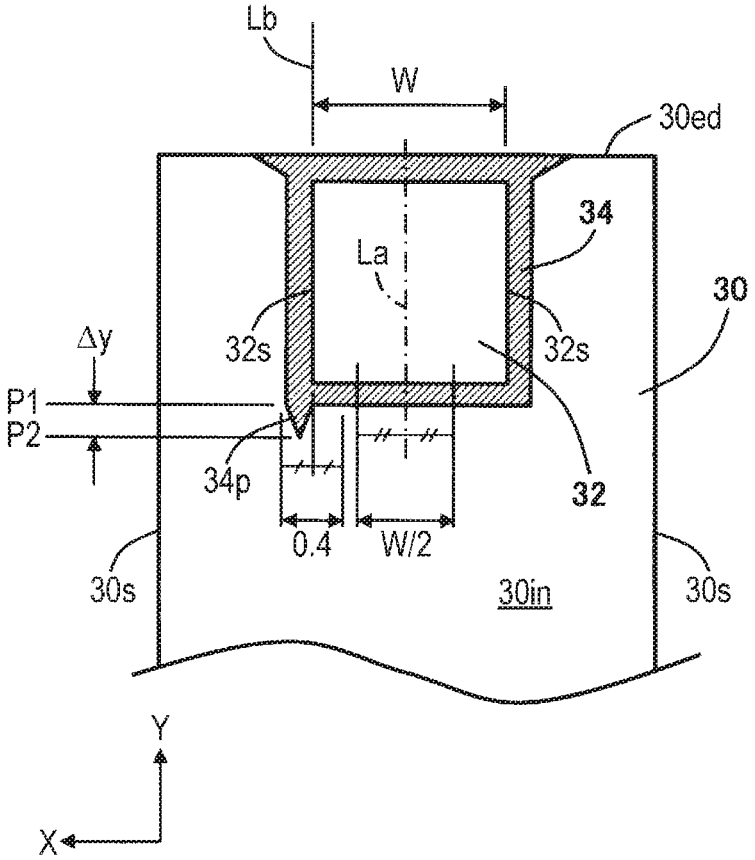
FIG. 3 illustrates the geometry of the ground electrode according to the embodiment.

FIG. 3 illustrates the geometry of the ground electrode 30 shown in FIG. 2A. The following symbols are used in FIG. 3.

(1) maximum tip width W: the maximum width of the noble metal tip 32 in the width direction X of the ground electrode 30

(2) straight line La: a straight line passing through the center of the noble metal tip 32 and extending in the longitudinal direction Y of the ground electrode 30

(3) contact line Lb: a line that is in contact with one of the side edges 32*s* of the noble metal tip 32 and extends in the longitudinal direction Y (4) first position P1: a position on the fused portion 34 that is within a distance of ±W/4 from the straight line La in the width direction X and that is farthest from the one end 30*ed* of the ground electrode 30

(5) second position P2: a position on the fused protrusion 34*p* that is within a distance of ±0.2 mm from the contact line Lb in the width direction X and that is farthest from the one end 30*ed* of the ground electrode 30

(6) length Δy: the length between the second position P2 and the first position P1 in the longitudinal direction Y Preferably, the length Δy between the second position P2 and the first position P1 satisfies the following expression.

$$\Delta y \geq 0.1 \text{ mm} \quad (1)$$

When this expression (1) is satisfied, the fused protrusion 34*p* protrudes by a sufficient length in the longitudinal direction Y, and therefore the separation resistance of the noble metal tip 32 is further improved. The length Δy is a dimension that is observed on an inner surface 30in of the ground electrode 30 in the plan view of FIG. 3. Inside the ground electrode 30 (below the inner surface 30in), the fused protrusion 34*p* may extend further in a direction away from the one end 30*ed* (in the −Y direction in FIG. 3).

Figure 4A:
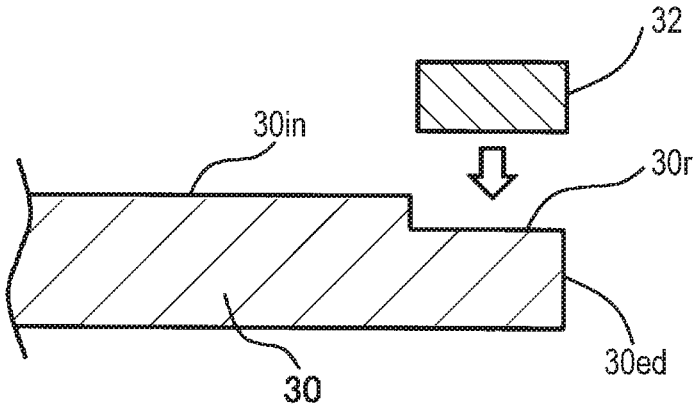
FIGS. 4A and 4B illustrate a process of joining a noble metal tip to the ground electrode.
Figure 4B:
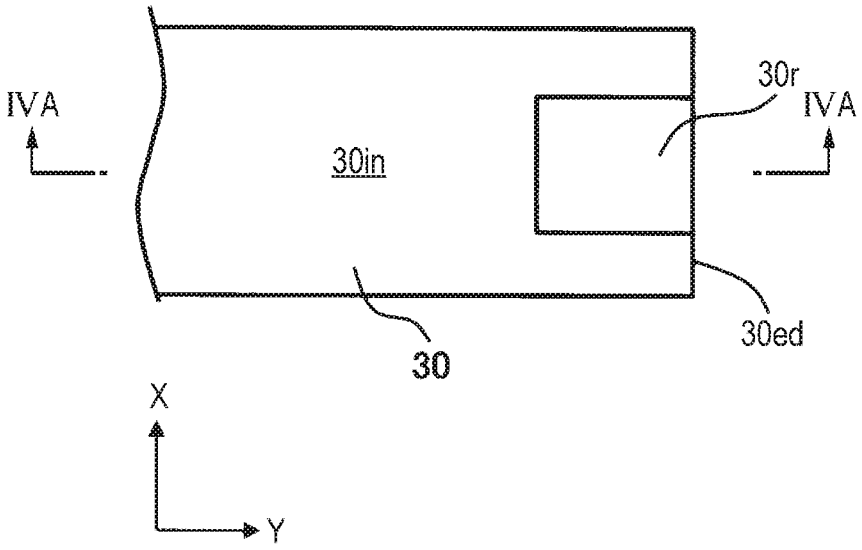

FIGS. 4A to 5B illustrate a process of joining the noble metal tip 32 to the ground electrode 30. FIG. 4B is a plan view of the ground electrode 30, on which the noble metal tip 32 is to be placed. FIG. 4A is a sectional view of the ground electrode 30, taken along line IVA-IVA, on which the noble metal tip 32 is being placed. A placement portion 30*r*, on which the noble metal tip 32 is to be placed, is formed near the end 30*ed* of the ground electrode 30. The placement portion 30*r* is a recessed portion that is recessed from the inner surface 30in of the ground electrode 30.

Figure 5A:
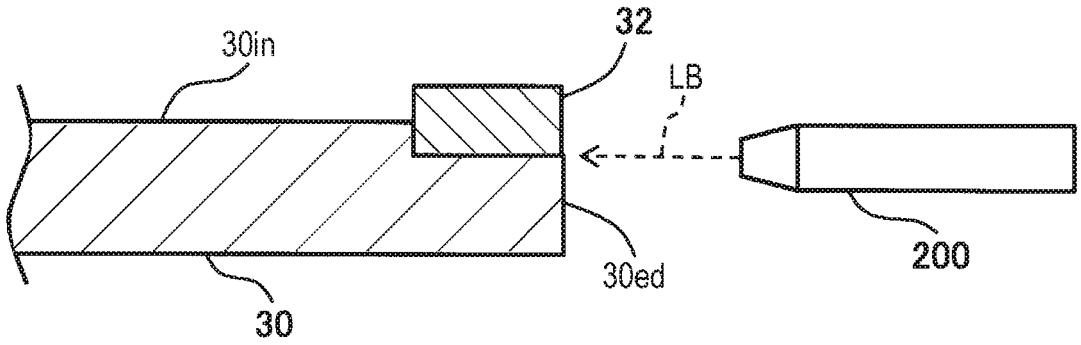
FIGS. 5A and 5B illustrate a process of joining the noble metal tip to the ground electrode.
Figure 5B:
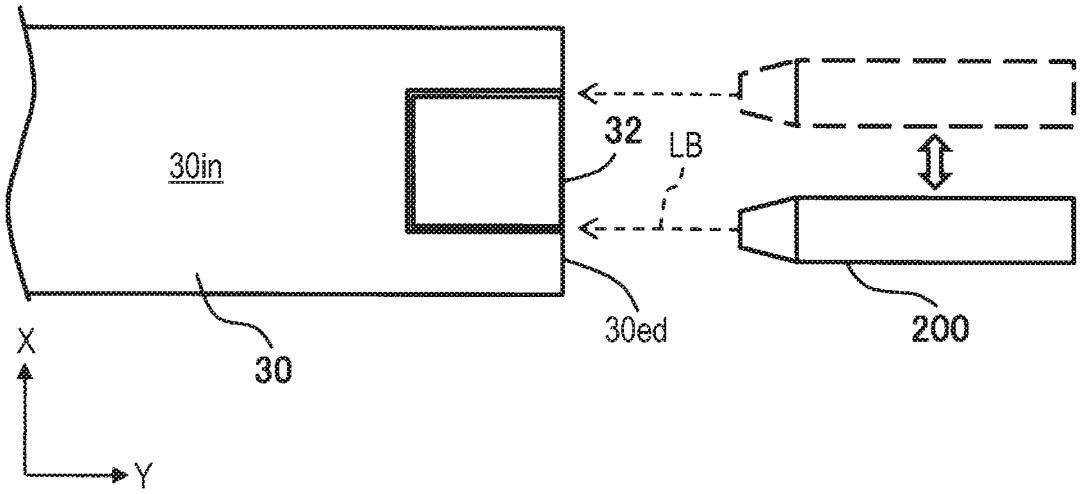

FIGS. 5A and 5B illustrate a state in which a light emitter 200 is emitting a laser beam LB toward the ground electrode 30, on which the noble metal tip 32 has been placed. The laser beam LB is emitted toward the end 30*ed* of the ground electrode 30 so that the boundary between the ground electrode 30 and the noble metal tip 32 is irradiated with the laser beam LB. The laser beam LB melts the boundary between the ground electrode 30 and the noble metal tip 32 to form the fused portion 34 (see FIGS. 2A to 3), thereby joining the ground electrode 30 and the noble metal tip 32 to each other. In doing so, preferably, the light emitter 200 reciprocates in the width direction X of the ground electrode 30 so that the laser beam LB scans the ground electrode 30 in the width direction X. For example, in an outgoing path (when scanning in the +X direction), a portion of the noble metal tip 32 close to the boundary between the ground electrode 30 and the noble metal tip 32 is scanned. In an incoming path (when scanning in the −X direction), a portion of the ground electrode 30 close to the boundary between the ground electrode 30 and the noble metal tip 32 is scanned. With this joining method, it is possible to form the fused protrusion 34*p* by controlling emission of the laser beam LB and to improve the separation resistance of the noble metal tip. In particular, when scanning the portion of the ground electrode 30 close to the boundary between the ground electrode 30 and the noble metal tip 32, by continuously emitting the laser beam LB having a sufficiently high intensity toward regions near both side edges 32*s* of the noble metal tip 32, it is possible to increase the size of the fused protrusion 34*p* that is formed near the side edges 32*s* of the noble metal tip 32.

In general, the ground electrode body 30 melts more easily than the noble metal tip 32. Therefore, when the ground electrode body 30 and the noble metal tip 32 are joined to each other by emitting the laser beam LB as shown in FIGS. 5A and 5B, the fused portion 34 is formed on the back surface of the noble metal tip 32 over an area larger than that of the outer shape of the noble metal tip 32. Inside the ground electrode 30, the fused portion 34 extends over an area that is larger than an area that is observed on the inner surface 30in of the ground electrode 30 in the longitudinal direction Y away from the one end 30*ed* (in the −Y direction in FIG. 3).

Figure 6A:
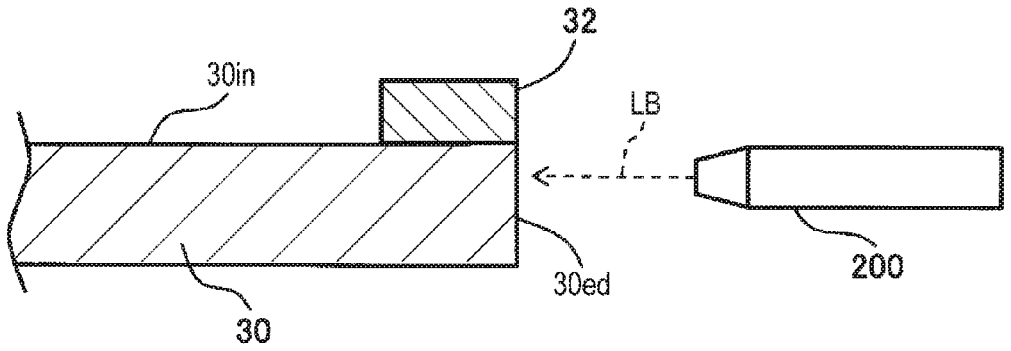
FIGS. 6A and 6B illustrate a process of joining a noble metal tip to a ground electrode, according to another embodiment.
Figure 6B:
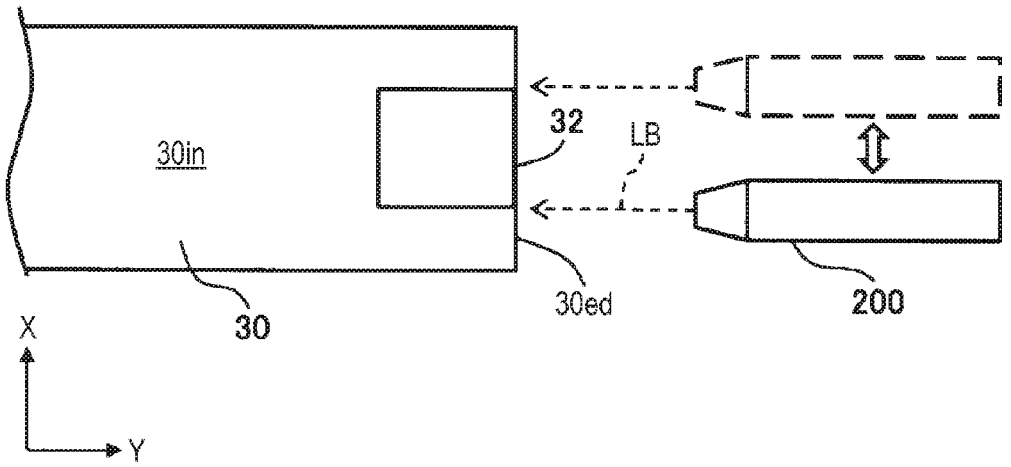

FIGS. 6A and 6B illustrate a process of joining a noble metal tip 32 to a ground electrode 30, according to another embodiment. In this example, the recessed placement portion 30*r* (FIGS. 4A and 4B) is not formed in the ground electrode 30, and the noble metal tip 32 is placed on an inner surface 30in of the ground electrode 30. Also in this case, in the same way as shown in FIGS. 5A and 5B, by emitting a laser beam LB toward the boundary between the ground electrode 30 and the noble metal tip 32, it is possible to form a fused portion 34 (FIGS. 2A to 3) by melting the boundary between the ground electrode 30 and the noble metal tip 32.

Figure 7A:
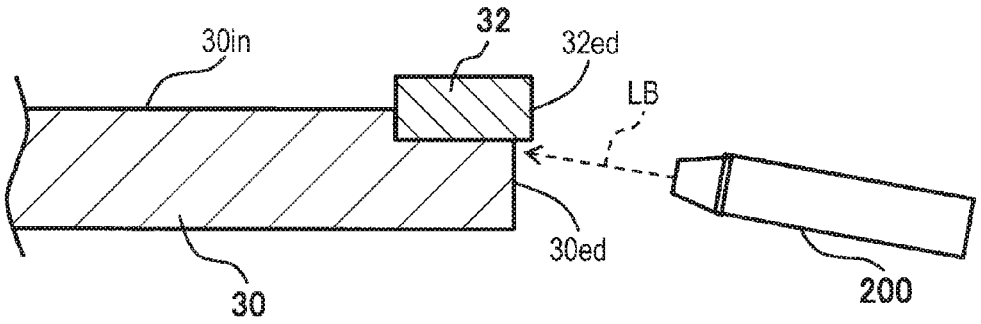
FIGS. 7A and 7B illustrate a process of joining a noble metal tip to a ground electrode, according to still another embodiment.
Figure 7B:
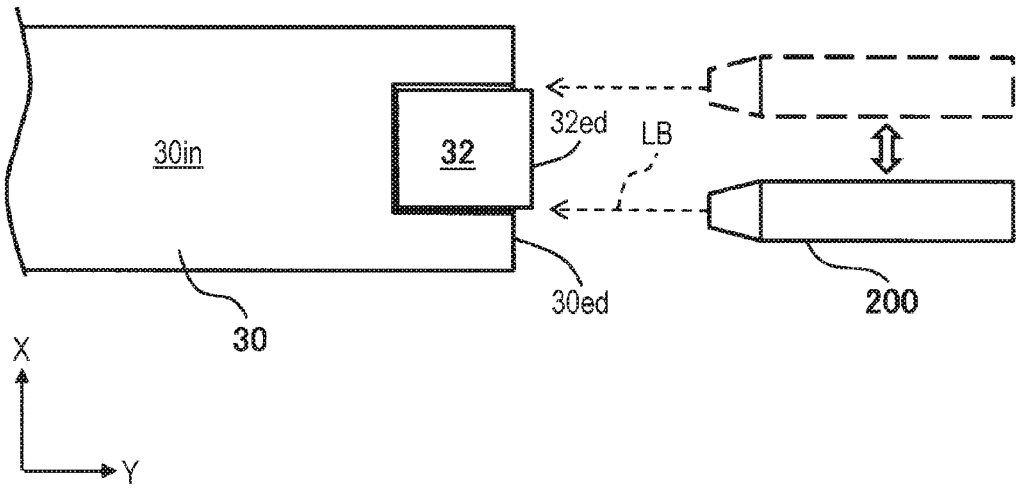

FIGS. 7A and 7B illustrate a process of joining a noble metal tip 32 to a ground electrode 30, according to still another embodiment. In this example, in a state in which an end portion 32*ed* of the noble metal tip 32 protrudes beyond the end 30*ed* of the ground electrode 30 outward in the longitudinal direction Y, the noble metal tip 32 is placed on the ground electrode 30 and a laser beam LB is emitted. In this case, the light emitter 200 may be held at an angle, and the laser beam LB may be emitted toward the boundary between the ground electrode 30 and the noble metal tip 32.

Figure 8:
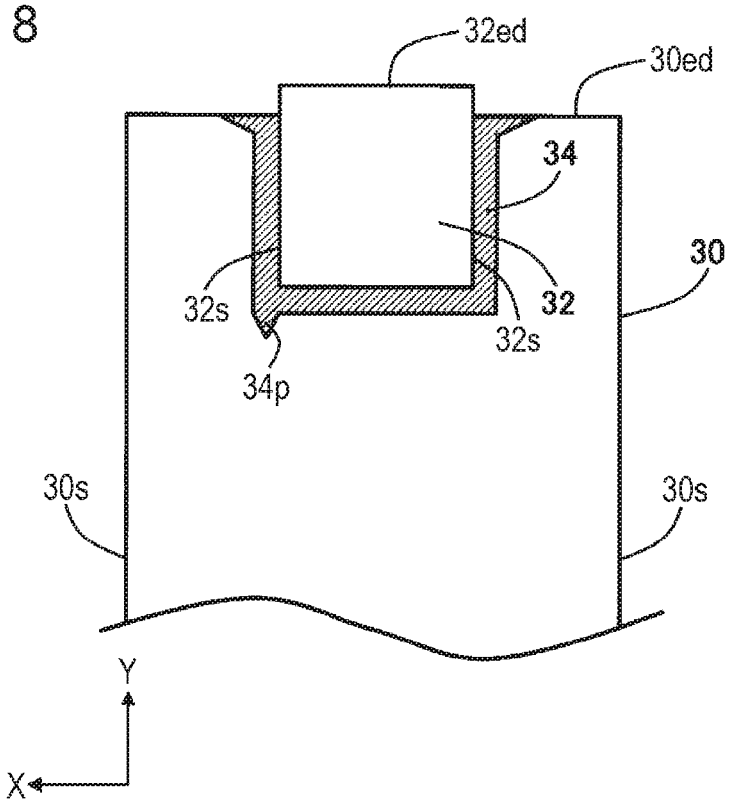
FIG. 8 illustrates the ground electrode obtained through the process shown in FIGS. 7A and 7B.

FIG. 8 illustrates the ground electrode 30 to which the noble metal tip 32 has been joined through the joining process shown in FIGS. 7A and 7B. In this example, the noble metal tip 32 is joined to the ground electrode 30 in a state in which the end portion 32*ed* of the noble metal tip 32 in the longitudinal direction protrudes beyond the end 30*ed* of the ground electrode 30 in the longitudinal direction Y. Also in this case, because the fused protrusion 34*p* is formed in the fused portion 34 in the same way as in FIG. 3, the ground electrode 30 has the same advantages as those of the ground electrode 30 shown in FIG. 3.

Figure 9:
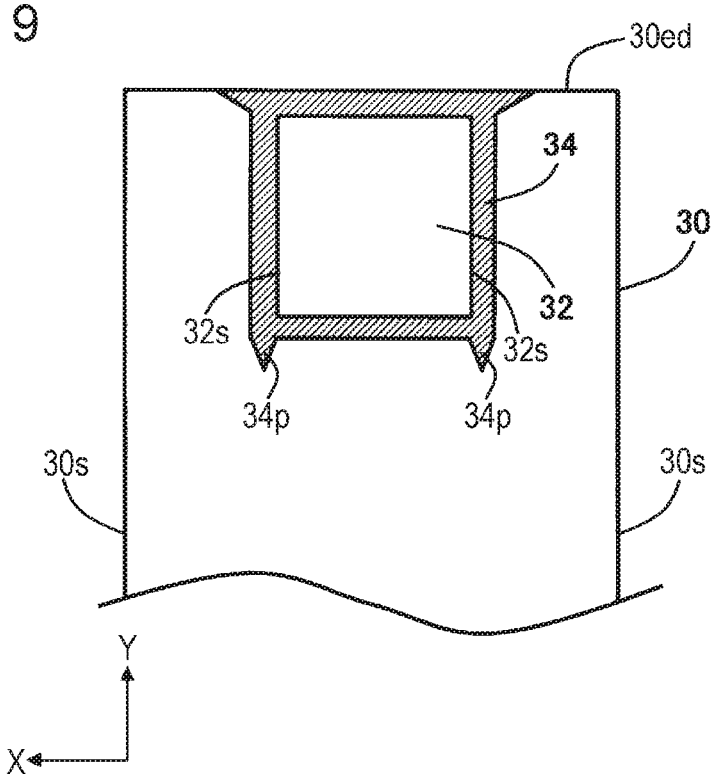
FIG. 9 illustrates a ground electrode according to another embodiment.

FIG. 9 illustrates a ground electrode 30 according to another embodiment. This ground electrode 30 differs from the ground electrode 30 shown in FIG. 3 in that a fused protrusion 34*p* is formed near each of two side edges 32*s* of the noble metal tip 32 in the width direction X of the ground electrode 30. In other respects, the ground electrode 30 shown in FIG. 9 is the same as the ground electrode 30 shown in FIG. 3. Also in this case, preferably, each of the two fused protrusions 34*p* satisfies the aforementioned expression (1). By forming two fused protrusions 34*p* in the fused portion 34, it is possible to further improve the separation resistance of the noble metal tip 32.

Figure 10:
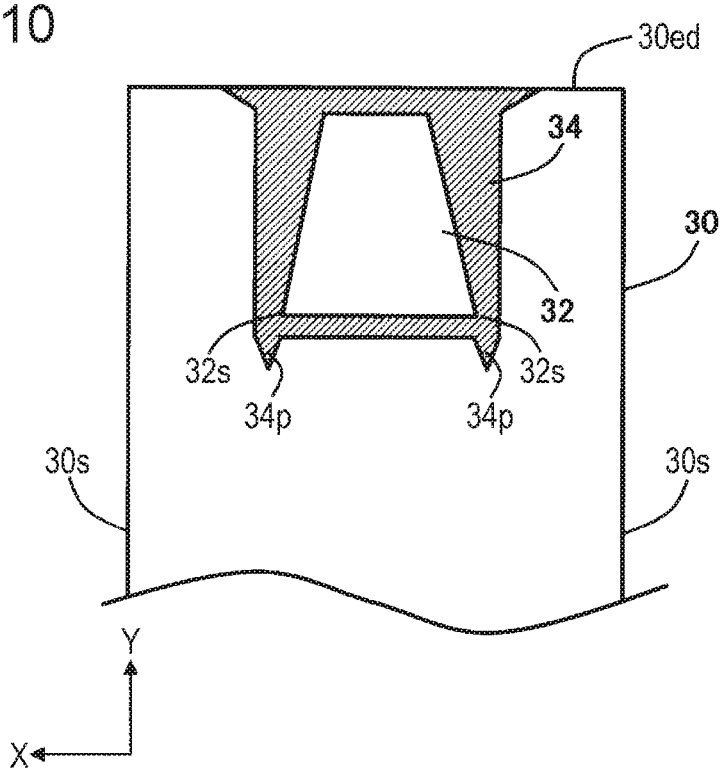
FIG. 10 illustrates a ground electrode according to still another embodiment.
Figure 11:
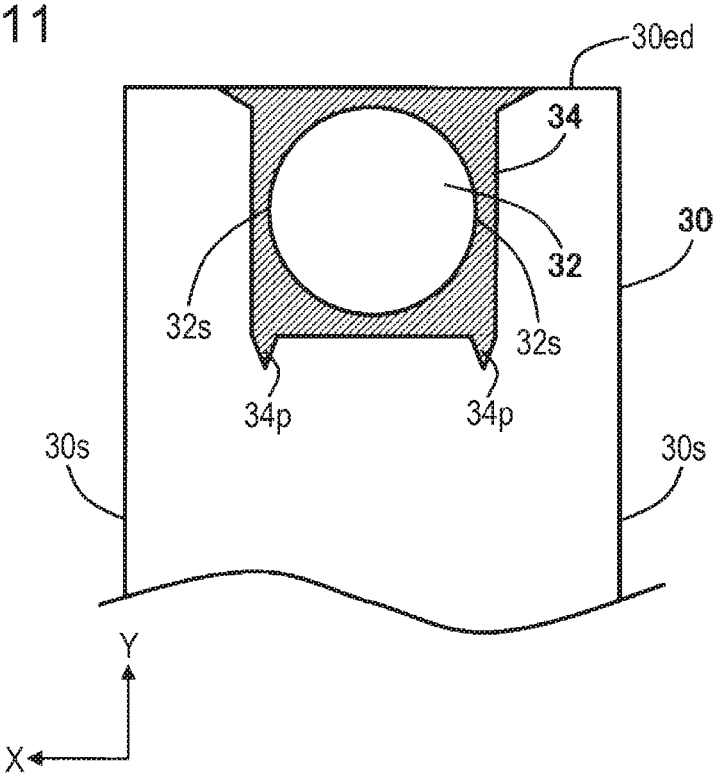
FIG. 11 illustrates a ground electrode according to still another embodiment.

FIGS. 10 and 11 each illustrate a ground electrode 30 according to still another embodiment. The ground electrode 30 shown in FIG. 10 differs from the ground electrode 30 shown in FIG. 9 in that the planar shape of the noble metal tip 32 is a trapezoid. In other respects, the ground electrode 30 shown in FIG. 10 is the same as the ground electrode 30 shown in FIG. 9. The ground electrode 30 shown in FIG. 11 differs from the ground electrode 30 shown in FIG. 9 in that the planar shape of the noble metal tip 32 is a circle. In other respects, the ground electrode 30 shown in FIG. 11 is the same as the ground electrode 30 shown in FIG. 9. Each of these ground electrodes 30 provides the same advantages as those of the ground electrode shown in FIG. 9. In these cases, one of the two fused protrusions 34*p* may be omitted.

FIG. 12 is a table showing the results of an experiment performed to examine the effect of the fused protrusion 34*p* on development of oxide scale. Samples having the same geometry as that shown in FIG. 3 and having the Mowing specifications were used in the experiment.

ground electrode 30: Ni alloy, 1.3 mm×2.7 mm noble metal tip 32: Pt—Ni alloy, 1.3 mm×1.3 mm number of fused protrusion 34*p:* 1 length Δy between two positions P1 and P2: 0.05 mm to 0.20 mm position Δ of fused protrusion 34*p:* −0.4 mm to +0.4 mm Here, the position Δ of the fused protrusion 34*p* is defined as follows: the position Δ is 0 when the tip of the fused protrusion 34*p* is located on the contact line Lb of one of the side edges 32*s* of the noble metal tip 32; the position Δ is positive when the tip of the fused protrusion 34*p* is displaced from the contact line toward the outside of the noble metal tip 32; and the position Δ is negative when the tip of the fused protrusion 34*p* is displaced from the contact line Lb toward the inside of the noble metal tip 32.

The test conditions for FIG. 12 are as follows.

temperature condition: the highest temperature of the front end of the ground electrode 30 1100° C.

thermal cycle: 3000 cycles, each consisting of heating for 2 minutes and slow cooling for 1 minute After subjecting each sample to thermal cycles, the ground electrode 30 and the noble metal tip 32 were cut along the straight line La passing through the center of the ground electrode 30, the section was observed by using a metallurgical microscope, and the length of oxide scale that had developed at the interface between the ground electrode 30 and the noble metal tip 32 was measured. Then, an oxide scale development ratio, which is the ratio of the length of developed oxide scale to the length of the interface, was calculated. In FIG. 12, the symbol "G" (Good) represents an oxide scale development ratio of less than 50%, and the symbol "F" (Fairy represents an oxide scale development ratio of 50% or greater. Note that, even in samples evaluated as "F," the oxide scale development ratio was lower than those of samples (not shown) that did not have the fused protrusion 34*p*. In general, as the oxide scale development ratio at the interface between the ground electrode 30 and the noble metal tip 32 decreases, the separation resistance of the noble metal tip 32 tends to increase.

As can be understood from the experiment results shown in FIG. 12, preferably, the position Δ of the fused protrusion 34*p* from the contact line Lb of one of the side edges 32*s* of the noble metal tip 32 is within a distance of ±0.2 mm in the width direction X. Preferably, the length Δy between the second position P2 and the first position P1 is 0.1 mm or greater. When these ranges of the parameters are satisfied, the oxide scale development ratio is small, and therefore the separation resistance of the noble metal tip 32 is further improved.

FIG. 13 is a table showing the results of another experiment performed to examine the effect of the fused protrusion 34*p* on development of oxide scale. The test conditions for FIG. 13 differ from those of FIG. 12 only in that a noble metal tip 32 having a circular planar shape with a diameter of 1.5 mm was used instead of the noble metal tip 32 having a square planer shape. The other test conditions are the same as those for FIG. 12. It can be understood that, also in FIG. 13, substantially the same results as those shown in FIG. 12 were obtained.

FIG. 14 is a table showing the results of still another experiment performed to examine the effect of the fused protrusion 34*p* on development of oxide scale. The test conditions for FIG. 14 differ from those of FIG. 12 only in that the number of thermal cycles was 5000 and the ranges of the parameters, that is, the ranges of the length Δy and the position Δ of the fused protrusion 34*p*, were narrower than those for FIG. 12. The other test conditions are the same as those for FIG. 12. From the experimental results shown in FIG. 14, it can be understood that it is most preferable that the position Δ of the fused protrusion 34*p* be on the contact line Lb of one of the side edges 32*s* of the noble metal tip 32.

FIG. 15 is a table showing the results of still another experiment performed to examine the effect of the fused protrusions 34*p* on development of oxide scale. The test conditions for FIG. 15 differ from those of FIG. 14 only in that the number of the fused protrusions 34*p* was two. The other test conditions are the same as those for FIG. 14. From the experimental results shown in FIGS. 14 and 15, it can be understood that it is preferable that the number of the fused protrusions 34*p* be two.

Modifications

The present invention is not limited to the embodiments and examples described above and may be carried out in various modifications within the sprit and scope of the present invention.

First Modification

The present invention can be applied to various spark plugs having structures different from that of the spark plug shown in FIG. 1. In particular, the specific shapes of the terminal nut and the insulator may be modified in various ways.

Having described the invention, the following is claimed:

1. A spark plug comprising:

a center electrode;

a ground electrode; and a noble metal tip that has a spark surface facing the center electrode with a spark gap therebetween and that is joined to a part of the ground electrode near one end of the ground electrode via a fused portion, wherein, from a viewpoint opposite a surface of the ground electrode at which the noble metal tip projects away from the ground electrode in a direction perpendicular to the spark surface:

an entirety of the fused portion extends outward beyond an outer shape of the noble metal tip so that the fused portion is present at all areas defined as being:

disposed between side edges of the ground electrode and side edges of the noble metal tip, respectively;

located inward from the side edges of the ground electrode; and separated from the side edges of the ground electrode in a width direction of the ground electrode; and the fused portion includes a fused protrusion that protrudes in a direction away from the one end of the ground electrode at a location near at least one of the side edges of the noble metal tip in the width direction of the ground electrode.

2. The spark plug according to claim 1, wherein, from the viewpoint opposite the surface of the ground electrode at which the noble metal tip projects away the around electrode in the direction perpendicular to the spark surface, $\Delta y \geq 0.1$ mm where:

a maximum tip width of the noble metal tip in the width direction of the ground electrode is denoted by W;

a straight line that passes through a center of the noble metal tip and that extends in a longitudinal direction perpendicular to the width direction is denoted by La;

a contact line that is in contact with the one of the side edges of the noble metal tip and that extends in the longitudinal direction is denoted by Lb;

a first position, which is a position on the fused portion that is within a distance of $\pm W/4$ from the straight line La in the width direction and that is farthest from the one end of the ground electrode, denoted by P1;

a second position, which is a position on the fused Protrusion that is within a distance of ±0.2 mm from the contact line Lb in the width direction and that is farthest from the one end of the ground electrode, is denoted by P2; and a length between the second position P2 and the first position P1 in the longitudinal direction is denoted by $\Delta y$.

3. The spark plug according to claim 1, wherein, from the viewpoint opposite the surface of the ground electrode at which the noble metal tip projects away the ground electrode in the direction perpendicular to the spark surface, the fused protrusion is present at locations near each of the side edges of the noble metal tip in the width direction of the ground electrode.

* * * * *